US005327765A

United States Patent [19]

Weykamp et al.

[11] Patent Number: 5,327,765

[45] Date of Patent: Jul. 12, 1994

[54] INTERNAL ARTICULATED MANDREL FOR THE STRETCH FORMING OF ELONGATED HOLLOW METAL SECTIONS

[75] Inventors: Robert E. Weykamp, Plum Boro; Thomas W. Scherf, Bethel Township, Armstrong County, both of Pa.

[73] Assignee: Aluminum Company of America, Pittsburgh, Pa.

[21] Appl. No.: 42,728

[22] Filed: Apr. 5, 1993

[51] Int. Cl.[5] ..... B21D 11/02; B21D 9/01

[52] U.S. Cl. ..... 72/296; 72/466; 269/48.1

[58] Field of Search ..... 72/296, 297, 466, 465, 72/482, 150, 393; 269/48.1

[56] References Cited

U.S. PATENT DOCUMENTS

| | | | |
|---|---|---|---|
| 2,089,476 | 8/1937 | Grotnes | 72/393 |
| 2,615,413 | 10/1952 | Adams | 269/48.1 |
| 2,889,864 | 6/1959 | Bowser | 72/465 |
| 3,266,285 | 8/1966 | Jensen | 72/304 |
| 3,330,021 | 7/1967 | Jacobsen | 269/48.1 |
| 3,747,394 | 7/1973 | Cunningham | 72/466 |
| 3,921,427 | 11/1975 | Malone et al. | 72/59 |
| 3,937,054 | 2/1976 | Hortvet et al. | 72/393 |
| 4,065,953 | 1/1978 | Frentzen et al. | 72/393 |
| 4,627,810 | 12/1986 | Von Holdt | 425/577 |
| 4,744,233 | 5/1988 | Trudell | 72/466 |
| 4,803,878 | 2/1989 | Moroney | 72/296 |
| 4,803,881 | 2/1989 | Dudley | 72/392 |
| 4,974,440 | 12/1990 | Brinegar | 72/392 |
| 5,101,653 | 4/1992 | Hermes et al. | 72/393 |

FOREIGN PATENT DOCUMENTS

| | | | |
|---|---|---|---|
| 1026 | 1/1984 | Japan | 72/466 |
| 963609 | 2/1983 | U.S.S.R. | 72/466 |
| 1397121 | 5/1988 | U.S.S.R. | 72/466 |

*Primary Examiner*—Daniel C. Crane

*Attorney, Agent, or Firm*—John I. Iverson; Thomas R. Trempus

[57] ABSTRACT

Disclosed is apparatus and a method for the stretch forming of an elongated hollow metal section, such as an aluminum extrusion. The apparatus and method of this invention uses a collapsible and expandable articulated mandrel positioned inside portions of the elongated hollow metal section to constrain and support the internal wall surfaces of the elongated hollow metal section against the reshaping forces imposed on the interior of the hollow metal section during the stretch forming operation. The mandrel disclosed herein prevents the formation of wrinkles and crimps being formed in the walls of the elongated hollow metal section during the stretch forming and reshaping thereof.

10 Claims, 3 Drawing Sheets

INTERNAL ARTICULATED MANDREL FOR THE STRETCH FORMING OF ELONGATED HOLLOW METAL SECTIONS

BACKGROUND OF THE INVENTION

This invention relates to apparatus and a method for the forming of elongated hollow metal sections into a predetermined shape or contour. It relates particularly to apparatus and a method for the bending or shaping of elongated hollow metal sections, such as aluminum extrusions, using "stretch forming" apparatus and methods. The stretch forming process for bending or shaping of an aluminum extrusion involves placing the ends of the extrusion into an opposed pair of jaws or clamps attached to a pair of opposed hydraulic cylinders and then applying sufficient tension through the hydraulic cylinders and jaws or clamps on the ends of the extrusion to "stretch" the metal in the extrusion beyond its yield point or elastic limit. While the metal is tensioned above the elastic limit, a forming die of desired shape and contour is pressed against the extrusion causing the extrusion to assume the desired shape and contour of the forming die. The tension on the ends of the extrusion is then reduced and the newly shaped extrusion is removed from the forming die and the stretch forming apparatus.

In the past, the stretch forming of elongated hollow metal sections, and especially thin walled aluminum extrusions, often produced crimps or wrinkles in certain portions of the walls of the section or extrusion as a result of the inability of the walls to resist the reshaping forces during the stretch forming operation. Such crimps and wrinkles not only weakened the extrusion but also resulted in an extrusion of unacceptable appearance.

While in some cases the crimps and wrinkles could be eliminated by using a thicker walled section, such a solution added to the cost of the finished product and increased its weight. U.S. Pat. No. 4,803,878 issued Feb. 14, 1989 to Moroney not only discloses the above-described apparatus and process for "stretch forming" of elongated hollow metal sections or extrusions, but also discloses one proposed solution to eliminate the crimps and wrinkles formed in the reshaping of thin walled extrusions. Moroney suggests that the crimps and wrinkles can be reduced or eliminated by introducing a gas under pressure into the interior of the elongated hollow metal section or extrusion while it is being stretch formed. Moroney claims that the internal gas pressure is sufficient to support the internal walls of the extrusion during the stretch forming operation and will prevent the formation of crimps and wrinkles. While the use of an internal pressurized gas has helped to reduce the formation of crimps and wrinkles, the use of the internal pressurized gas alone has not completely eliminated crimps and wrinkles in elongated hollow metal sections or extrusions of complex cross-sectional shape and has increased the reshaping cycle time and cost required to produce an acceptable finished product by the "stretch forming" process.

It has been known to use both external and internal mandrels to prevent the crimping and wrinkling of tubing, pipe and other hollow elongated metal sections while they are being bent. Some of the known mandrels are bendable or flexible to allow support by the mandrel throughout the bending operation. U.S. Pat. No. 3,747,394 to Cunningham discloses a flexible, expandable internal mandrel used to bend large diameter pipe. The mandrel is supported internally within the pipe on rollers. Cunningham's mandrel uses a plurality of pipe engaging shoes that are clamped tightly in place against the pipe by plurality of toggle joints.

SUMMARY OF THE INVENTION

It is therefore an object of this invention to provide apparatus and a method useful for the stretch forming of elongated hollow metal sections which will resist crimping or wrinkling of the elongated hollow metal section as it is being reshaped during the stretch forming operation.

It is another object of this invention to provide apparatus and an associated method that allows the stretch forming of elongated hollow metal sections into a finished or semi-finished product having accurate dimensions, contours and a smooth appearance.

It is still another object of this invention to provide apparatus and an associated method for the stretch forming of elongated hollow metal sections that can be easily adapted to existing stretch forming equipment and practices without an increase in the reshaping cycle time or increase in costs.

It is another object of this invention to provide apparatus and an associated method for the stretch forming of elongated hollow metal sections that can be adapted for the forming and shaping of a wide variety of cross sections of elongated hollow metal sections and extrusions.

We have discovered that the foregoing objects can be attained by providing apparatus and an associated method for the stretch forming of an elongated hollow metal section into a predetermined contour comprising means to grip the opposed ends of the elongated hollow metal section, a forming die member having a forming die face adapted to reshape the elongated hollow metal section and a collapsible and expandable articulated mandrel positioned inside the elongated hollow metal section. The apparatus includes means to tension the elongated hollow metal section above its elastic limit. The internal articulated mandrel is comprised of two diametrically opposed groups of articulated support members connected by elastomeric spacers. Each group of articulated support members may be connected to a common reversible drive shaft by links which cause the collapse or expansion of the mandrel. The mandrel, when expanded, supports selected positions of the inner periphery of the elongated hollow metal section and is adapted to constrain the forces on the inner wall surfaces of the elongated hollow metal section while it is reshaped by the forming die member under tension.

In applying this apparatus to the method of this invention, the articulated mandrel is inserted into the interior of the elongated hollow metal section and expanded to support selected portions on the inner periphery of the the metal section, tension is then applied to the ends of the metal section until the section is tensioned above its elastic limit. The metal section is then reshaped to the desired contour or shape against a forming die member.

DESCRIPTION OF THE PREFERRED EMBODIMENTS

Figure 1:
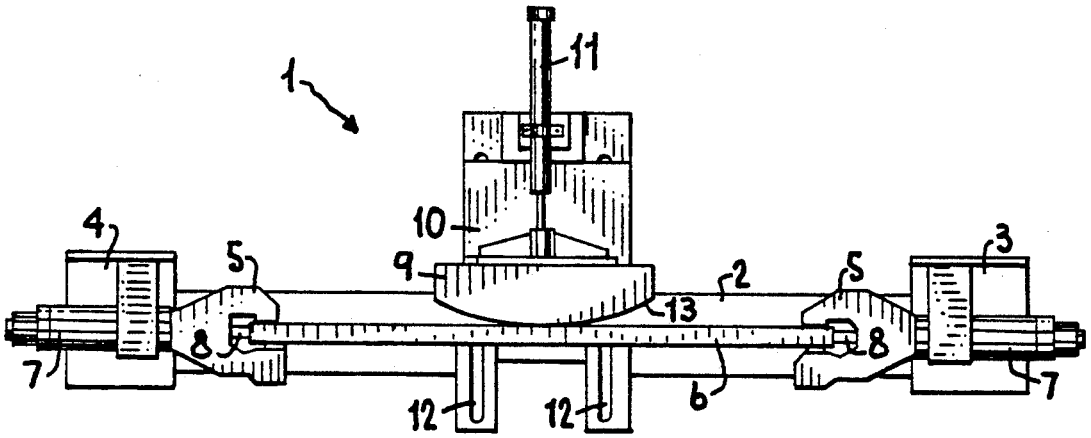
FIG. 1 is a top plan view of a typical stretch forming apparatus used to reshape elongated hollow metal sections and illustrating the apparatus with a hollow metal section in the apparatus prior to the stretch forming operation.
Figure 2:
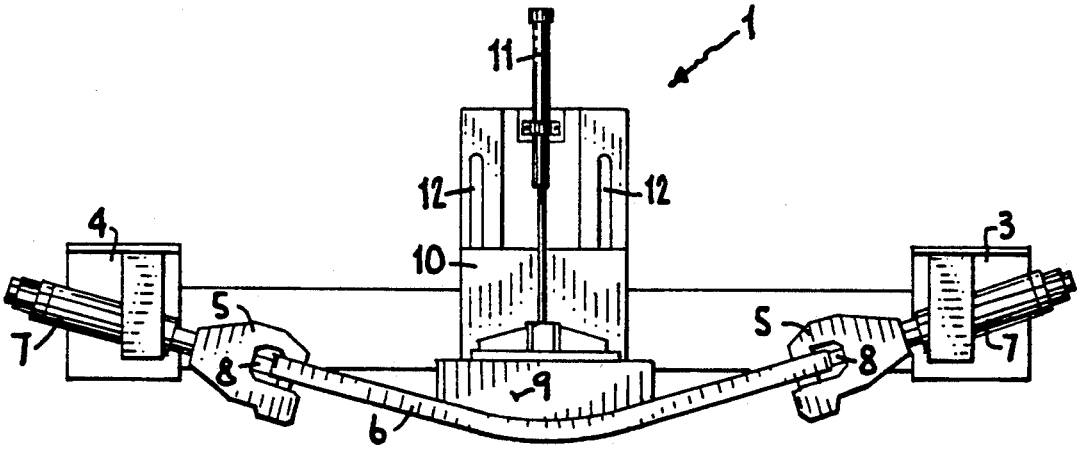
FIG. 2 is a top plan view of the same stretch forming apparatus shown in FIG. 1, illustrating the hollow metal section as it is being stretch formed by the forming die member while the metal in the hollow metal section is tensioned above its elastic limit.

FIGS. 1 and 2 illustrate a typical apparatus and methods used to "stretch form" an elongated hollow metal section, such as an aluminum extrusion. As shown in FIGS. 1 and 2, the stretch forming apparatus 1 comprises an elongated foundation bed or table 2 having a pair of carriages 3 and 4 at each end of the bed or table 2. The carriages 3 and 4 are positioned on the bed or table 2 a suitable distance apart for the length of the extrusion to be stretch formed and then locked into place. The carriages 3 and 4 do not move during the stretch forming operation.

Each of the carriages 3 and 4 is equipped with a clamp or jaws 5 which are designed to tightly grip and hold the ends of the extrusion 6 to be reshaped and stretch formed. Each of the carriages 3 and 4 are also provided with hydraulic pistons and cylinders 7 to provide a tensioning force to the ends of the extrusion 6 when gripped in the clamps or jaws 5.

The stretch forming apparatus 1 is provided with a die member 9 mounted on a movable die carriage 10. The die carriage 10 and the die member 9 are able to be moved transversely to the axis of the foundation bed or table 2 along parallel guide rails 12 by a hydraulic piston and cylinder 11. The die member 9 has a die face portion 13 shaped to provide the desired curve or contour to the extrusion 6 and is often provided with a die cavity machined into the die face portion 13 to accommodate at least a portion of the cross section of the extrusion 6 be stretch formed.

As shown in FIG. 2, the reshaping or stretch forming of the extrusion 6 is performed by first activating the tension pistons and cylinders 7 attached to the clamps or jaws 5 which tightly hold the ends of the extrusion 6. Enough tension is applied to the ends of the extrusion 6 to exceed the elastic limit of the metal in the extrusion and thereby place the metal in the "yield state" where the metal is susceptible to easy reshaping and forming. Once the metal is tensioned to the "yield state", the die carriage 10 and the die member 9 are moved forward by the hydraulic piston and cylinder 11 along the guides 12 until the die member reshapes the extrusion 6 into the desired contour or shape, as illustrated in FIG. 2. Also illustrated by FIG. 2 and more fully described in the above-mentioned U.S. Pat. No. 4,803,878 to Moroney, the clamps or jaws 5 are permitted to pivot to provide the proper angle tangent to the curve being formed in the extrusion 6.

During the reshaping operation by the die member 9, selected portions of the internal wall surfaces of the extrusion 6 are supported by the collapsible and expandable articulated mandrel 15 to resist any forces that would tend to wrinkle or crimp the walls of the extrusion 6.

Figure 3:
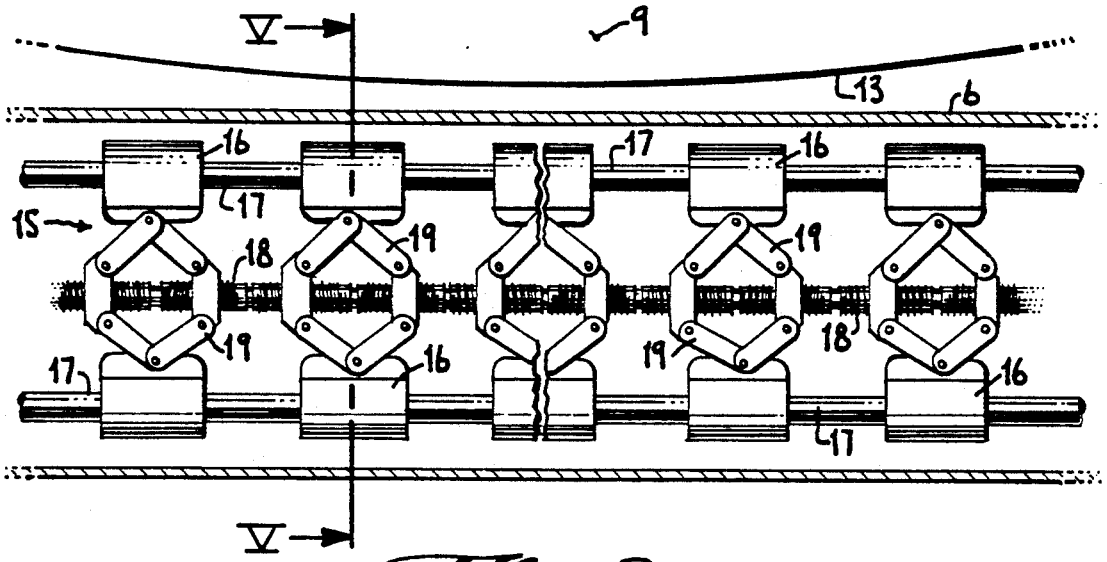
FIG. 3 is a cross-sectional view of the mandrel used in the apparatus of this invention while in a collapsed state to permit its insertion or removal from the interior of the hollow metal section.
Figure 4:
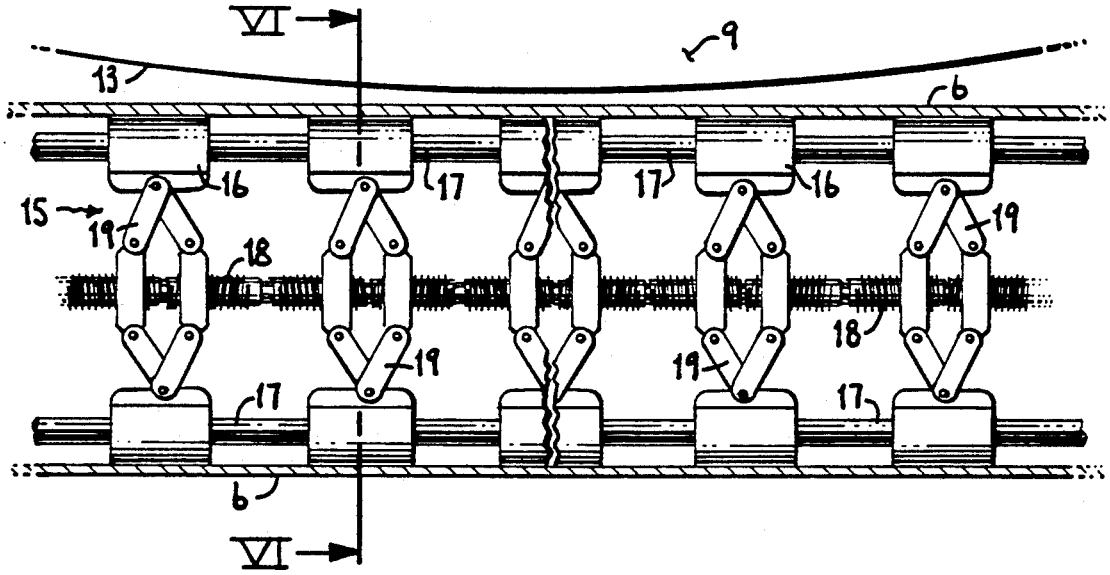
FIG. 4 is a cross-sectional view similar to FIG. 3 showing the mandrel used in the apparatus of this invention in an expanded state.
Figure 5:
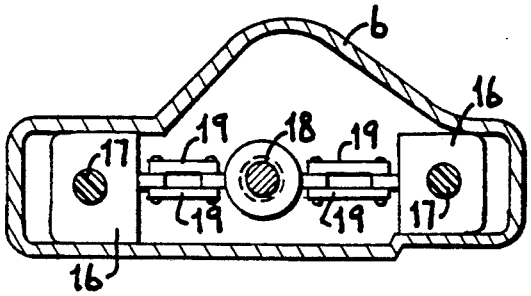
FIG. 5 is a section taken along the section lines V—V of FIG. 3.
Figure 6:
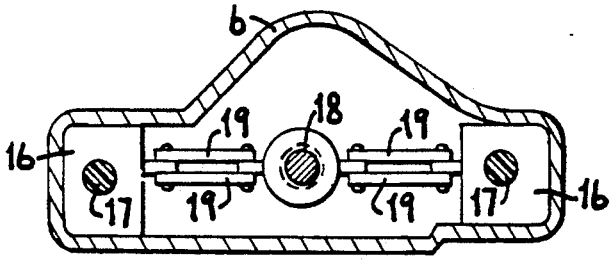
FIG. 6 is a section taken along the section lines VI—VI of FIG. 4.

In FIGS. 3, 4, 5 and 6, we have illustrated a preferred embodiment of the collapsible and expandable articulated mandrel 15 of this invention. In FIGS. 3 and 5, the mandrel 15 is shown in a collapsed position to permit its insertion or removal from the interior of the extrusion 6. In FIGS. 4 and 6, the mandrel is shown in an expanded position to support selected portions of the inner periphery of the extrusion 6 and constrain the forces on the walls of the extrusion 6 during the stretch forming thereof.

The collapsible and expandable articulated mandrel 15 of this embodiment comprises two groups of a plurality of closely spaced, articulated support members 16, each about ¼ to ½ inches thick and made of steel, aluminum, plastic or similar hard materials, machined to a contour to fit into selected portions of the extrusion 6, as best illustrated in FIGS. 5 and 6. The closely spaced support members 16 are connected together into a group by flexible elastomeric spacers 17, each about ¼ to ½ inches thick, and made of rubber or other elastomeric material to form a group of interconnected closely spaced support members 16.

The diametrically opposed groups of the support members 16 are designed to fit tightly, when expanded, in selected portions of the inner periphery of the extrusion 6. The cross-sectional shape of the support members 16 conforms to the interior cross-section of selected diametrically opposed portions of the extrusion 6, as best illustrated in FIGS. 5 and 6. As illustrated in FIGS. 5 and 6, the cross-sectional shape of the support members 16 in one group will often be different from the cross-sectional shape of the support members in the other group in order to fit within the selected portions of the extrusion 6.

The closely spaced support members 16 and the elastomeric spacers 17 allow the mandrel 15 to flex and rotate slightly during the stretch forming operation and the movement of the die member 9, and still provide sufficient internal support to the walls of the extrusion 6.

In the preferred embodiment of this invention, the two diametrically opposed groups of support members 16 are connected to a central, threaded common drive shaft 18 by parallel links 19, as shown in FIGS. 3, 4, 5 and 6, which allows the mandrel or be expanded or collapsed by rotation of the the shaft 18.

In use, the mandrel 15 is inserted into the interior of the extrusion 6 in a collapsed position, as shown in FIGS. 3 and 5. The mandrel 15 may extend within the extrusion 6 for the full length of the forming die face 13 or just in selected shorter portions of the extrusion 6 depending on the nature and extent of the reshaping required for the extrusion 6. The mandrel 15 is inserted, either manually or with a power assist, to the proper position in the extrusion 6 before starting the stretch forming operation. The central drive shaft 18 is then rotated manually or with a power source, causing the links 19 to move, in parallel, to a position substantially perpendicular to the longitudinal axis of the extrusion 6 and thereby forcing both groups of support members 16 tightly against selected portions of the inner wall surface of the extrusion 6. The mandrel 15 is held in this expanded position until completion of the stretch forming operation. Reversal of the drive shaft 18 then allows for the collapse of the mandrel 15, allowing it to be easily removed from the interior of the extrusion 6 at the completion of the stretch forming operation.

The mechanism associated with the drive shaft 18 and links 19 may be threaded toggles, cam levers or rack and pinion links to transmit the rotary movement of drive shaft 18 to transverse movement of the links 19.

It is understood that this embodiment is just one example of the apparatus of this invention and is provided for the purposes of illustrating this invention and not for the purpose of limitation.

We claim:

1. Apparatus for the stretch forming of an elongated hollow tube-like metal section into a predetermined contour, comprising means to grip the opposed ends of said elongated hollow metal section and to tension said elongated hollow metal section above its elastic limit, a forming die member having a forming die face adapted to reshape said elongated hollow metal section and a collapsible and expandable articulated mandrel positioned inside said elongated hollow metal section, said mandrel positioned inside said elongated hollow metal section, said mandrel comprised of two diametrically opposed groups of articulated support members for contacting inner wall surfaces of said elongated hollow metal section, each group of said articulated support members comprised of a plurality of closely spaced support members connected to each other with separate, diametrically opposed elastomeric spacers, means to expand said mandrel, said mandrel when expanded by moving said opposed groups of support members away from one another supporting selected portions of the inner wall surfaces of said elongated hollow metal section by said support members and adapted to constrain the forces on the inner wall surfaces of said hollow metal section during the stretch forming thereof.

2. The apparatus of claim 1 in which said mandrel extends inside said elongated hollow metal section substantially the full length of the forming die face.

3. The apparatus of claim 1 having a common means to move the two groups of articulated support members closer together or farther apart from each other.

4. The apparatus of claim 1 in which each said group of articulated support members is connected to a reversible drive shaft by links.

5. An expandable and collapsible mandrel for supporting diametrically opposed selected portions of the inner wall surfaces of an elongated hollow tube-like metal section during the reshaping thereof, comprising two diametrically opposed groups of closely spaced support members for contacting the inner wall surfaces, the support members in each group connected to each other with elastomeric spacers and having a common means to move the two groups of closely spaced support members closer together or farther apart from each other, the elastomeric spacers being separate and diametrically opposed relative to the common means.

6. The mandrel of claim 5 in which the means for moving said groups of support members closer together or farther apart from each other is a reversible drive shaft and links.

7. The mandrel of claim 5 in which the support members in one group have a different cross-sectional shape than the support members in the other group.

8. A method for stretch forming an elongated hollow tube-like metal section comprising placing a collapsible and expandable articulated mandrel inside said metal section, expanding said mandrel to support selected portions of the inner wall surfaces of said mandrel section by moving support members on said mandrel away from one another into engagement with the inner wall surfaces, gripping the opposed ends of said elongated hollow metal section and applying a tension to said metal section above its elastic limit and reshaping said metal section against a die member while said metal section is tensioned above its elastic limit and while said support members engage the inner surfaces of the metal section.

9. The method of claim 8 in which the selected portions of the inner periphery of said elongated hollow metal section being supported by said mandrel are diametrically opposed to each other.

10. The method of claim 9 in which the diametrically opposed selected portions of the inner periphery of said elongated hollow metal section have different cross-sectional shapes.

* * * * *